US005665476A

United States Patent [19]

Oez

[11] Patent Number: 5,665,476

[45] Date of Patent: Sep. 9, 1997

[54] TRANSFER PAPER AND A PROCESS FOR TRANSFERRING PHOTOCOPIES TO TEXTILES

[76] Inventor: Buelent Oez, Am Exerzierplatz 3a, Mannheim, Germany, D-68167

[21] Appl. No.: 558,110

[22] Filed: Nov. 13, 1995

[51] Int. Cl.[6] ..... B41M 5/10

[52] U.S. Cl. ..... 428/488.4; 428/195; 428/425.1; 428/481; 428/486; 428/511; 428/530; 428/688; 428/914

[58] Field of Search ..... 428/501, 502, 428/480, 537.5, 423.1, 47.1, 195, 425.1, 481, 486, 488.4, 511, 530, 686, 914

[56] References Cited

U.S. PATENT DOCUMENTS

| | | | |
|---|---|---|---|
| 3,262,838 | 7/1966 | Vieth et al. | 162/8 |
| 3,281,267 | 10/1966 | Rice | 117/155 |
| 4,271,221 | 6/1981 | Hosmer | 428/172 |
| 4,603,079 | 7/1986 | Nishizaki | 428/323 |
| 5,360,456 | 11/1994 | Lecomte et al. | 8/471 |

FOREIGN PATENT DOCUMENTS

| | | |
|---|---|---|
| 0 466 503 | 1/1992 | European Pat. Off. . |
| 0 522 898 | 1/1993 | European Pat. Off. . |
| 42 10 976 | 4/1993 | Germany . |

*Primary Examiner*—William Krynski
*Attorney, Agent, or Firm*—Foley & Lardner

[57] ABSTRACT

The present invention relates to a transfer paper for transferring colored xerocopy prints to textile substrates and to a process for the production of prints, in particular produced by xerocopy, on textiles, in which a layer of plastic on a carrier paper is first printed on and is transferred to the textile under the action of heat, the print being produced on the carrier paper with a coating comprising a melamine-formaldehyde resin esterified with methanol, a polyurethane and an acrylic acid ester/acrylic acid copolymer.

20 Claims, No Drawings

TRANSFER PAPER AND A PROCESS FOR TRANSFERRING PHOTOCOPIES TO TEXTILES

BACKGROUND OF THE INVENTION

The present invention relates to a transfer paper and to a process for transferring photocopies to textiles, such as, in particular, T-shirts.

Such transfer papers carry a layer of plastic which absorbs the print and is transferred in the hot state to the textile, the print being ironed onto the textile and, if appropriate after a certain cooling time, the paper being peeled off, after which the plastic and print remain on the fabric. Since the photocopy is a positive proof, a negative print is formed on the textile. If a positive image is desired on the fabric, a negative print must be produced before the transfer, as described, for example, in EP-05 22 898 A1 and DE-42 10 976 A1.

Conventional prints are not satisfactory in respect of the brilliance of the image transferred, especially on black textiles, and the resistance to washing at higher temperatures. White textiles must be subsequently ironed after washing in order to intensify faded colors again.

SUMMARY OF THE INVENTION

The object of the present invention is therefore to provide a transfer paper with the aid of which positive prints can be produced directly, which prints furthermore have a coating of plastic which ensures a greater brilliance of the image and into which a white pigment can be incorporated, especially for printing black textiles. Furthermore, it should be possible to employ water as the only solvent during production of the coating and the print should be washable up to above 90° C. and likewise of a high color stability during repeated washing. Finally, subsequent ironing after washing should be dispensed with.

This object is achieved according to the invention by a transfer paper which has, as the coating of plastic, at least: a polyurethane which can be cross-linked under the action of heat by a melamine-formaldehyde resin esterified with methanol, mixed with an acrylic acid ester/acrylic acid copolymer, the latter being a thickener.

DETAILED DESCRIPTION OF THE PREFERRED EMBODIMENTS

The advantage of such a coating is that the coating (after production of the photocopy on this) can be peeled off from the paper as a film and can be laid as a positive on the textile substrate to be ironed on and to bond with the textile fibers. It is furthermore of essential importance that a white pigment ($TiO_2$) can be incorporated into the mixture so that the prior white coating of dark (black) textiles hitherto necessary can now be dispensed with and the print can be transferred immediately with a single film.

In order to be able to establish the handle or softness of the image, it is furthermore proposed to employ a mixture of two polyurethane components, one of which is more flexible.

A mixture in the following weight ratio is particularly suitable for production of the coating:

2.5–10 parts by weight of melamine-formaldehyde resin as a 70% strength aqueous solution, 200–300 parts by weight of polyurethane as a 40% strength aqueous dispersion and 7–36 parts by weight of thickener in a 25% strength aqueous dispersion, the latter values depending on the desired process or application to the paper, and, for the screen printing application process, 7 parts by weight being employed for finer screens and 36 parts by weight for coarser screens. Application can, of course, also be by doctor blade coating.

To improve the quality of the processability, it is proposed to add auxiliaries such as paraffin and/or antifoams and/or wetting agents and/or flow control agents to the mixture.

The paraffin component is used here for easier peeling off of the film produced from the paper and at the same time renders the surface non-tacky.

Suitable polyurethane components are, in particular, ionic or nonionic polyether- or polyester-polyurethanes.

Preferably, the wetting agent employed is the sodium salt of sulfosuccinic acid and the flow control agent employed is methoxymethylated melamine, together with nonionic surfactants in a suitable mixing ratio.

The coating can preferably be produced from a mixture of 2.5–10 parts by weight of a melamine-formaldehyde resin esterified with methanol (dissolved in water), 0–5 parts by weight of an aqueous anionic paraffin emulsion, 0–100 parts by weight of titanium dioxide pigment, 0–1 part by weight of antifoam (based on mineral oil), 200–300 parts by weight of an aqueous dispersion of an anionic polyester-polyurethane, 0–0.5 part by weight of sodium sulfosuccinate, 0.5–2 parts by weight of a flow control agent and 7–36 parts by weight of a 25% strength aqueous dispersion of an acrylic acid ester/acrylic acid copolymer, the components being mixed in 10–20 parts by weight of water and stirred to give a free-flowing composition.

If white textiles are to be printed on, the titanium oxide pigment can also be omitted.

Up to 50 parts by weight of an aqueous acrylic acid N-butyl ester/styrene copolymer dispersion can be added to the mixture.

It is furthermore proposed to provide a coating of an ethylene/vinyl acetate terpolymer, preferably with 9–28% of vinyl acetate and 0.5–3% of maleic acid groups, between the paper (weight about 100 g/m$^2$) and the polyurethane layer. This layer has substantial advantages—on the one hand a coating of high heat resistance which can be washed up to about 95° C. is formed, and on the other hand a matt soft handle is achieved with undiminished color strength and a very high resistance to washing.

Textiles printed on according to the invention have the essential advantage that the image does not fade due to washing and subsequent ironing to increase the brilliance of the color is thus dispensed with completely.

The paper according to the invention can be used particularly advantageously on dark (black) fabrics.

For such purposes, it was hitherto necessary for a white-colored plastisol layer first to be applied to the fabric, for example pressed on from a paper by ironing. This had to have approximately the contour of the image, which was then applied, appropriately cut, to the white coating. Various problems arise here, the edges become blurred, the image must be cut in mirrored form and the contour is limited to simple outlines, such as, for example, rectangles. If instead a transparent printed film is ironed against an opaque second film in order then to apply the laminate to the textile, there is the difficulty that the image must be viewed through the carrier paper for cutting out, which does not allow precise results.

According to the invention, a much simpler procedure can now be followed. After the coated paper has been printed on, for example with the aid of a photo-copier, the image can be cut out on the paper and with this without effort. The coating bonded adhesively to the paper as a film is then detached and placed with the viewing side, i.e. in a positive image, on the textile substrate. The polyurethane layer is then crosslinked under pressure and heat, the heat preferably being allowed to act from the reverse of the fabric, i.e. the fabric is ironed "from the wrong side". As can be seen, an essential difficulty of all the printing processes known hitherto is dispensed with, i.e. the print can be applied directly to the textile.

In order to protect the film during ironing, the paper on which the print was first can be laid in a simple manner on the side carrying the toner, i.e. on the outside, or a corresponding larger paper can be chosen for the cutting.

For easier peeling off of the film coating, the paper can also be provided with a release layer of wax or silicone in a manner known per se.

The present invention is illustrated in more detail with the aid of the following examples. All parts in the examples are parts by weight.

EXAMPLE 1

Transfer paper for transferring colored xerocopy prints onto textile substrates, comprising a carrier paper and a coating on this, the coating comprising a melamine-formaldehyde resin esterified with methanol as the crosslinking component which can be activated by heat, at least one anionic polyester-polyurethane and an acrylic acid ester/acrylic acid copolymer as the thickener.

EXAMPLE 2

| | |
|---|---|
| 20 parts | of water |
| 5 parts | of aqueous 60% anionic paraffin emulsion (Basophob; trademark of BASF) |
| 5 parts | of a melamine-formaldehyde resin esterified with methanol in a 70% strength aqueous solution (Saduren DS 2060; trademark of BASF) |
| 80 parts | of foamed titanium oxide, rutile modification (Helizarin Weiss; trademark of BASF) |
| 0.2 part | of antifoam based on mineral oil (Nopco 8034 E; trademark of Münzig Chemie) |
| 150 parts | of anionic polyester-polyurethane in a 40% strength aqueous dispersion (Emuldur DS 2299; trademark of BASF) |
| 0.2 part | of sodium sulfosuccinate (Lumiten IRA; trademark of BASF) (50% strength, water) |
| 2 parts | of methoxymethylated melamine mixed with nonionic surfactants (Luprintol M; trademark of BASF) |
| 20 parts | of an acrylic acid ester/acrylic acid copolymer in a 25% strength aqueous dispersion (Latekoll D; trademark of BASF). |

The substances are mixed and homogenized in the 20 parts of water and the mixture is applied to a paper (for example: blade-coating, screen printing) and allowed to set. A film which can be printed on, can be peeled off completely from the paper and can be ironed onto a textile at elevated temperatures is formed.

EXAMPLE 3

The following are introduced into 30 parts of water:

| | |
|---|---|
| 5 parts | of melamine-formaldehyde resin esterified with methanol (Saduren DS 2060) |
| 80 parts | of rutile pigment (Helizarin Weiss RTU) |

-continued

| | |
|---|---|
| 0.5 part | of antifoam (Nopco 8034 E) |
| 100 parts | of acrylic acid N-butyl [sic] ester/styrene copolymer in an aqueous dispersion (Acronol S 795; trademark of BASF) |
| 100 parts | of anionic polyester-polyurethane in aqueous dispersion (Emuldur DS 2299) |
| 0.2 part | of sodium sulfosuccinate (Lumiten IRA) |
| 2 parts | of a methoxymethylated melamine in water/solvent with nonionic surfactants (Luprintol M) |
| 30 parts | of acrylic acid esters/acrylic acid copolymer (Latekoll D, 25% strength) |

EXAMPLE 4

Mixture for white textiles without added pigment:

| | |
|---|---|
| 10 parts | of water |
| 5 parts | of Basophob WDS |
| 10 parts | of Saduren DS 2060 |
| 0.2 part | of Lumiten IRA |
| 100 parts | of Emuldur DS 2299 |
| 36 parts | of Latekoll D |

A thick composition which can be applied by blade-coating is formed.

EXAMPLE 5

| | |
|---|---|
| 10 parts | of water |
| 5 parts | of Basophob WDS |
| 100 parts | of Saduren DES 2060 |
| 0.2 part | of Lumiten IRA |
| 190 parts | of Emuldur 381 A |
| 50 parts | of Acronal S 795 |
| 70 parts | of Latekoll D |

A thin liquid mixture compared to that of Example 4 which can be applied through a fine screen in screen printing is formed.

The products mentioned are commercial products and are employed in the form marketed.

I claim:

1. Transfer paper for transferring colored xerocopy prints to textile substrates, comprising a carrier paper and a coating on the carrier paper, wherein the coating comprises a) 2.5 to 10 parts by weight of a melamine-formaldehyde resin esterified with methanol as a crosslinking component;

b) 200 to 300 parts by weight of at least one polyurethane; and c) 7–36 parts by weight of an acrylic acid ester/acrylic acid copolymer as a thickener.

2. Transfer paper according to claim 1, wherein the coating additionally comprises titanium dioxide as a pigment.

3. Transfer paper according to claim 1, wherein a mixture of two anionic polyester-polyurethanes is employed as the polyurethane component.

4. Transfer paper according to claim 1, wherein the coating additionally comprises one or more of paraffin, an antifoam agent, a wetting agent, or a flow control agent.

5. Transfer paper according to claim 1, wherein a sodium salt of a sulfosuccinic acid ester is employed as a wetting agent and a methoxymethylated melamine together with a nonionic surfactant is employed as a flow control agent.

6. Transfer paper according to claim 1, wherein the coating is obtained from a free-flowing composition comprising

| | | |
|---|---|---|
| 10–20 | parts by weight | of water |
| 2.5–10 | parts by weight | of a melamine-formaldehyde resin esterified with methanol, dissolved in water |
| 0–5 | parts by weight | of an aqueous anionic paraffin emulsion |
| 0–100 | parts by weight | of a titanium oxide pigment |
| 0–1 | part by weight | of an antifoam agent based on mineral oil |
| 200–300 | parts by weight | of an aqueous dispersion of an anionic polyester-polyurethane |
| 0–0.5 | part by weight | of sodium sulfosuccinate |
| 0.5–2 | parts by weight | of a flow control agent |
| 30–180 | parts by weight | of a 25% strength aqueous dispersion of an acrylic acid ester/acrylic acid copolymer. |

7. Transfer paper according to claim 6, wherein up to 50 parts by weight of an aqueous acrylic acid N-butyl ester/styrene copolymer dispersion are additionally present in the coating.

8. Transfer paper according to claim 1, wherein the melamine formaldehyde resin is in the form of a 70% strength aqueous solution, the polyurethane is in the form of a 40% aqueous dispersion; and the copolymer is in the form of a 25% strength aqueous dispersion.

9. A method of using the transfer paper according to claim 1 to transfer a photocopy to a textile, comprising producing a photocopy on the coating layer, peeling off the coating layer from the carrier paper, applying the peeled-off coating layer to the textile, and crosslinking the polyurethane by application of heat.

10. A method according to claim 9, wherein the textile is black.

11. A method according to claim 9, wherein the textile is a T-shirt.

12. Transfer paper according to claim 1, wherein a layer of an ethylene/vinyl acetate maleic anhydride terpolymer is located between the carrier paper and the coating.

13. Transfer paper according to claim 12, wherein the terpolymer contains 9–28% by weight of vinyl acetate and 0.5 to 3% by weight of maleic anhydride.

14. Transfer paper according to claim 1, wherein a release layer of wax or silicone is located on the carrier paper between the carrier paper and the coating.

15. Transfer paper according to claim 1, wherein the coating is obtained from a composition containing water as the only solvent.

16. A method according to claim 9, wherein the heat for crosslinking is applied by an iron from the reverse side of the textile.

17. Transfer paper according to claim 1, wherein the coating comprises paraffin.

18. Transfer paper according to claim 6, wherein the coating composition comprises the aqueous anionic paraffin emulsion, titanium oxide, an antifoam agent based on mineral oil, and sodium sulfosuccinate.

19. Transfer paper according to claim 7, wherein the mixture comprises the acrylic acid N-butyl ester/styrene copolymer.

20. Transfer paper according to claim 1, wherein the polyurethane is selected from the group consisting of ionic or non-ionic polyether urethanes or ionic or non-ionic polyester urethanes.

* * * * *